US005676321A

United States Patent [19]

Kroger

[11] Patent Number: 5,676,321

[45] Date of Patent: Oct. 14, 1997

[54] CUTTING DISK

[75] Inventor: Bruce R. Kroger, West Chicago, Ill.

[73] Assignee: Fellowes Mfg. Co., Itasca, Ill.

[21] Appl. No.: 415,534

[22] Filed: Apr. 3, 1995

[51] Int. Cl.[6] ..... B02C 18/16

[52] U.S. Cl. ..... 241/236; 241/293; 241/295

[58] Field of Search ..... 241/166, 167, 241/236, 295, 293

[56] References Cited

U.S. PATENT DOCUMENTS

| | | |
|---|---|---|
| 1,019,828 | 3/1912 | O'Bryan . |
| 1,090,914 | 3/1914 | Guettler . |
| 1,178,386 | 4/1916 | Edwards . |
| 1,673,336 | 6/1928 | Lehmicke . |
| 1,699,157 | 1/1929 | Pendleton . |
| 1,731,967 | 10/1929 | Antonsen . |
| 2,182,219 | 12/1939 | Ashley . |
| 2,202,843 | 6/1940 | Edwards . |
| 2,216,612 | 10/1940 | Dimm et al. . |
| 2,224,948 | 12/1940 | Bloomquist . |
| 2,236,969 | 4/1941 | Flateboe . |
| 2,259,015 | 10/1941 | Anderson et al. . |
| 2,381,775 | 8/1945 | Roddy . |
| 2,554,114 | 5/1951 | Menkin et al. . |
| 2,657,720 | 11/1953 | Wolfe . |
| 2,770,302 | 11/1956 | Lee . |
| 2,873,923 | 2/1959 | Bergman . |
| 2,894,697 | 7/1959 | Panning et al. . |
| 3,033,064 | 5/1962 | Lee . |
| 3,126,931 | 3/1964 | Blanshine et al. . |
| 3,286,574 | 11/1966 | Durand . |
| 3,369,763 | 2/1968 | Perry . |
| 3,396,914 | 8/1968 | Liebman . |
| 3,510,077 | 5/1970 | Priscu . |
| 3,524,597 | 8/1970 | Burden, Jr. et al. . |
| 3,529,782 | 9/1970 | Liebman . |
| 3,620,461 | 11/1971 | Pelleschi et al. . |
| 3,620,462 | 11/1971 | Dooley, Jr. . |
| 3,630,460 | 12/1971 | Goldhammer . |
| 3,664,592 | 5/1972 | Schweigert et al. . |
| 3,682,402 | 8/1972 | Goldhammer . |
| 3,711,034 | 1/1973 | Ehinger . |
| 3,724,766 | 4/1973 | Bosland . |
| 3,790,093 | 2/1974 | McIntyre . |
| 3,797,765 | 3/1974 | Samuels . |
| 3,860,180 | 1/1975 | Goldhammer . |
| 3,880,361 | 4/1975 | Schwarz . |
| 3,894,697 | 7/1975 | Lawson et al. . |
| 3,921,920 | 11/1975 | Brocard . |
| 3,931,935 | 1/1976 | Holman . |
| 3,960,334 | 6/1976 | Wudyka . |
| 3,991,944 | 11/1976 | Baikoff . |
| 4,009,838 | 3/1977 | Tashman . |
| 4,018,392 | 4/1977 | Wagner . |
| 4,034,918 | 7/1977 | Culbertson et al. . |
| 4,068,805 | 1/1978 | Oswald . |
| 4,106,708 | 8/1978 | Kropa . |
| 4,157,671 | 6/1979 | Goldhammer . |
| 4,172,400 | 10/1979 | Brierley . |
| 4,194,698 | 3/1980 | Kosmowski . |
| 4,200,239 | 4/1980 | Simone et al. . |
| 4,226,372 | 10/1980 | Wigand . |

(List continued on next page.)

FOREIGN PATENT DOCUMENTS

| | | |
|---|---|---|
| 10681 | 10/1979 | European Pat. Off. . |
| 0 069 721 | 1/1983 | European Pat. Off. . |
| 3001507 | 7/1981 | Germany . |
| 705066 | 3/1954 | United Kingdom . |
| 1502076 | 2/1978 | United Kingdom . |
| 1558423 | 3/1978 | United Kingdom . |
| 1569375 | 6/1980 | United Kingdom . |
| 2 097 717A | 3/1982 | United Kingdom . |

*Primary Examiner*—Mark Rosenbaum
*Attorney, Agent, or Firm*—Brinks Hofer Gilson & Lione

[57] ABSTRACT

A cylindrical cutting disk for use in a shredder having a plurality of circumferentially spaced teeth, each tooth having a tapered and angled cutting edge. In a preferred embodiment, the disk includes a spacer located on one side of the disk, the spacer having a smooth outer surface and an inner lining coextensive with the lining of the central aperture of the disk. A plurality of disks may be mounted on a cutting cylinder. The disk can be made by sintering.

25 Claims, 1 Drawing Sheet

U.S. PATENT DOCUMENTS 4,257,565 3/1981 Hatanaka .
4,260,115 4/1981 Hatanaka .
4,330,092 5/1982 Roman .
4,334,650 6/1982 Hardwick e al. .
4,346,851 8/1982 Bernardi et al. .
4,349,159 9/1982 Hardwick et al. .
4,351,485 9/1982 Hardwick et al. .
4,355,766 10/1982 Wigand .
4,363,453 12/1982 Hill et al. .
4,385,732 5/1983 Williams .
4,394,983 7/1983 Ulsky .
4,399,946 8/1983 Stevenson .
4,411,391 10/1983 Crane .
4,426,044 1/1984 Butler .
4,489,897 12/1984 Turner et al. .
4,522,096 6/1985 Niven, Jr. .
4,545,537 10/1985 Kimura et al. .
4,557,421 12/1985 Probst et al. .
4,558,827 12/1985 Berger .
4,562,971 1/1986 Schwelling .
4,564,146 1/1986 Bleasdale .
4,565,330 1/1986 Katoh .
4,615,490 10/1986 Goldhammer .
4,619,407 10/1986 Goldhammer .
4,625,925 12/1986 Goldhammer .
4,627,581 12/1986 Holiman et al. .
4,627,582 12/1986 Goldhammer .
4,637,560 1/1987 Goldhammer .
4,650,128 3/1987 Goldhammer .
4,651,610 3/1987 Schwelling .
4,657,192 4/1987 Browning .
4,688,730 8/1987 Dahle .
4,690,340 9/1987 Hatanaka .
4,691,871 9/1987 Mochizuki .
4,693,428 9/1987 Raterman et al. .
4,709,197 11/1987 Goldhammer et al. .
4,717,085 1/1988 Crane .
4,773,603 9/1988 Schwelling .
4,809,916 3/1989 Schwelling .
4,830,295 5/1989 Schwelling .
4,860,963 8/1989 Goldhammer et al .
4,881,692 11/1989 Goldhammer et al. .
4,889,291 12/1989 Goldhammer et al. .
4,936,517 6/1990 Kammerer et al. .
4,997,134 3/1991 MacGregor .
5,044,270 9/1991 Scwelling .
5,071,080 12/1991 Herbst et al. .
5,141,168 8/1992 Pepper .
5,170,702 12/1992 Schwelling .
5,230,477 7/1993 Strohmeyer .
5,261,614 11/1993 Schwelling .
5,328,107 7/1994 Tsai ..... 241/295

CUTTING DISK

BACKGROUND OF THE INVENTION

This invention relates to a cutting disk for use in a shredder and the method of making the disk.

Generally, there are two types of cutting mechanisms, "straight cut" or "strip" and "cross cut." A "straight cut" shredder cuts the paper into long, thin strips of paper. This result may be undesirable because the long thin strips make it possible to reassemble the original documents.

A "cross cut" shredder, on the other hand, generally comprises a pair of parallel cutting cylinders that contain a series of offset cutting disks arranged along the axis of the cylinders. Cross cut shredders produce small paper chips. Although this result is more desirable, the current designs are problematic. Cross cut cylinders machined from solid steel or individual machine cutters must be made from hardened material or must be hardened after machining to be strong enough to withstand the staples and paperclips, which will inevitably be put into the shredder along with paper. All of these options are expensive. Individual cutters with the cutting edges extending beyond the perimeter of the cutter have been made inexpensively of sintered or stamped metal, but these cutters require more power and are louder than cross cut cutters whose cutting edges do not protrude beyond the perimeter of the disk.

A cross cut cutting cylinder containing inexpensive cutting disks that enable a low noise, low power shredder to efficiently cut paper would be a welcome improvement in the art.

SUMMARY OF THE INVENTION

The invention provides a cutting disk having a plurality of circumferentially spaced teeth that do not protrude past the perimeter of the disk, each tooth having a cutting edge, each cutting edge being tapered and angled in the same direction as the cutting edges of the other teeth. In the preferred embodiment, the disk also includes a spacer located on one side of the disk, the spacer having a smooth outer surface and an inner lining that is coextensive with the lining of the central aperture of the disk.

The invention also includes a cutting cylinder having a hexagonal shaft and a plurality of cutting disks mounted on the shaft, each cutting disk having a plurality of circumferentially spaced teeth that do not protrude past the perimeter of the disk, each tooth having a cutting edge, each cutting edge being tapered and angled in the same direction as the cutting edges of the other teeth, and a central aperture for placing the disk on the shaft.

In addition, the present invention encompasses a shredder having two parallel cutting cylinders, each cylinder having a hexagonal shaft and a plurality of spaced apart cutting disks with the cutting disks of the first cutting cylinder interleaved with the cutting disks of the second cutting cylinder, each cutting disk having a plurality of circumferentially spaced teeth that do not protrude past the perimeter of the disk, each tooth having a cutting edge that is tapered and angled, each cutting edge being tapered and angled in the same direction as the other teeth, and a central aperture for placing the disk on the shaft.

The invention further includes the method of making the above-described cutting disk by molding and sintering.

DETAILED DESCRIPTION OF THE DRAWINGS AND PREFERRED EMBODIMENTS OF THE INVENTION

Figure 1:
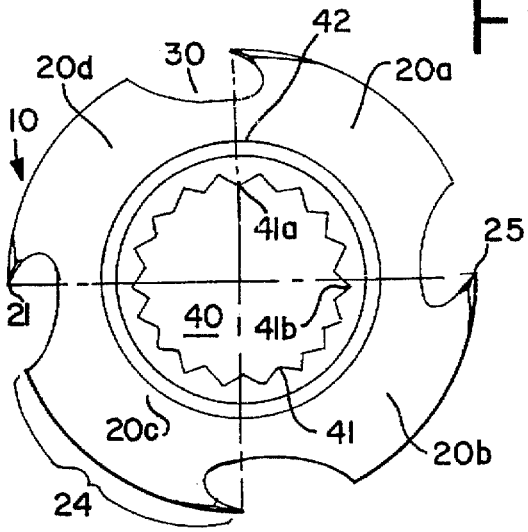
FIG. 1 is a side view of the preferred cutting disk.

FIG. 1 shows the preferred embodiment of the cutting disk 10 of the present invention. As illustrated, the cutting disk 10 is cylindrical and includes a plurality of circumferentially spaced teeth 20 that do not protrude past the perimeter of the disk. The preferred disk 10 has four teeth 20 positioned ninety degrees from one another. Each tooth 20 has a cutting edge 21 that is tapered on the top and angled. Tapering and angling the cutting edge 21 provides a sharp surface which can easily penetrate the material that is to be shredded. As clearly shown in FIG. 4, the cutting edge 21 is preferably tapered to an angle 22 in the range of 20 to 45 degrees, more preferably 25 to 40 degrees, and most preferably 35 degrees. The curing edge 21 is preferably angled 23 in the range of 20 to 90 degrees, more preferably 30 to 75 degrees, and most preferably 45 degrees.

In the preferred embodiment, the cutting edge 21 of each tooth 20 is tapered 22 and angled 23 in the same direction as the cutting edges 21 of the other teeth 20. The teeth 20 on the cutting disk 10 are separated by a plurality of circumferentially spaced gullets 30. In the preferred embodiment, there are an equal number of teeth 20 and gullets 30. The cutting surface 24 of the disk 10 may extend from the cutting edge 21 to the beginning of the next gullet 30.

The disk 10 also has a central aperture 40 which enables the disk 10 to be placed on a shaft 50. The aperture 40 is lined with a plurality of serrations 41. The serrations 41 allow the disk 10 to be offset along the shaft 50 of a cutting cylinder 60 and thus provide a means of offsetting individual disks 10 with respect to each other. In the preferred embodiment, there are eighteen serrations 41.

Figure 3:
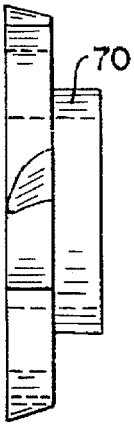
FIG. 3 is a front view of the cutting disk of FIG. 1.
Figure 6:
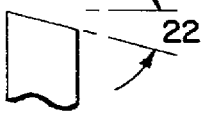
FIG. 6 is an enlarged view of the tapered cutting edge of the teeth on the cutting disk of FIG. 1.

As illustrated in FIG. 3, the preferred embodiment of the cutting disk 10 includes a spacer 70 located on one side of the disk 10. The spacer 70 has a smooth outer surface and an inner lining that is coextensive with the lining of the central aperture 40. Preferably the spacer 70 is integral with the body of the disk. Alternately, the spacer 70 may be a separate component which provides distance between individual disks 10 on a cutting cylinder 60. If the spacer 70 is a separate component, it is preferably attached or affixed to the body of the disk 10. Any method of attachment presently known in the art is appropriate. When the disks 10 are used in a dual cylinder shredding machine, the disks 10 are arranged in an interleaving pattern which will be further described hereafter. Thus, disks 10 on one cylinder **60*a* must be positioned so that a disk 10 from another cylinder 60*b* could be positioned between them. Therefore, although the actual size of the spacer 70 is not critical, the spacer 70 must be slightly wider than an individual disk 10**.

Figure 2:
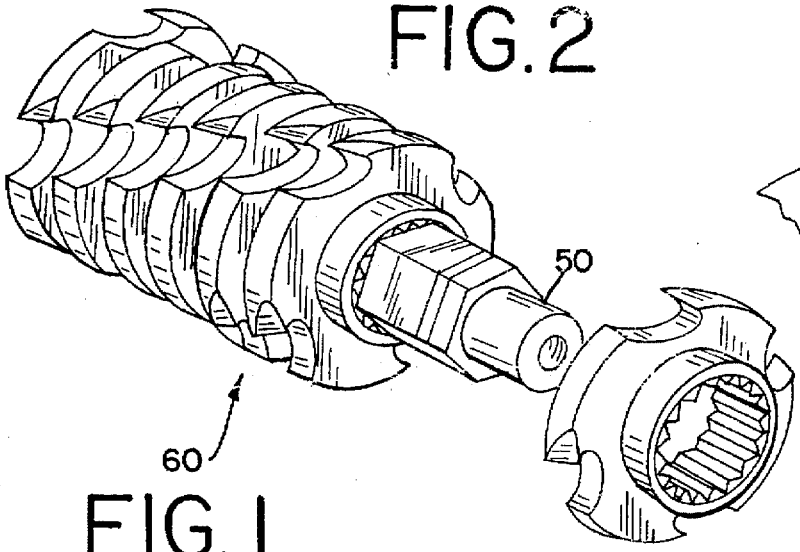
FIG. 2 is an exploded view of a portion of a cutting cylinder containing a plurality of the cutting disks of FIG. 1.

FIG. 2 depicts a cutting cylinder 60 containing a plurality of the cutting disks 10 of the present invention. As illustrated, the cutting cylinder 60 has a shaft 50 upon which the cutting disks 10 are mounted. In the preferred embodiment, the shaft 50 has a hexagonal cross-section. The cutting disks 10 are somewhat reciprocally displaced, or indexed, in the longitudinal direction of the cutting cylinder 60 so that a large pitch helix is formed on the surface. The helical displacement insures that the engagement of the teeth 20 into the paper to be shredded is gentle and takes place continuously along the longitudinal direction of the cutting cylinder 60. The reciprocal displacement between disks 10 on the cutting cylinder 60 may vary in several respects. First, the amount or degree of displacement may vary. Preferably, the reciprocal displacement is not more than a fraction of an inch or a few millimeters or fractions thereof. In the preferred embodiment, the disks 10 are staggered by ten degrees. Secondly, the disks 10 may be staggered individually, as shown in FIG. 2, or in groups of two or more. For example, a group of four individual cutting disks 10 may be reciprocally displaced from the adjacent group of four individual cutting disks 10. Alternately, a group of two disks may be staggered from the adjacent group of three disks. Any pattern or grouping of disks 10 that produces the desired helix is acceptable.

Figure 4:
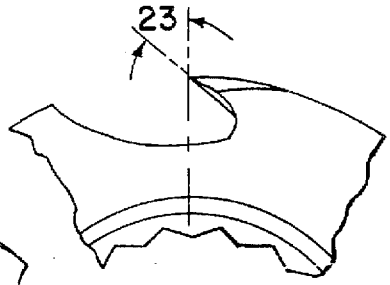
FIG. 4 is an enlarged view of the cutting edge of the teeth on the cutting disk of FIG. 1.

As explained previously, the preferred cutting disk 10 of the present invention has a central aperture 40 lined with eighteen serrations 41. Although the serrations 41 are twenty degrees each, it is possible to offset the disks 10 on a hexagonal shaft 50 in ten degree increments as depicted in FIG. 2. More specifically, the relationship between the tip 25 of the cutting edge 21 and the serrations 41 lining the aperture 40 allow disks 10 to be offset from each other by ten degrees. As best illustrated in FIGS. 1 and 4, each disk 10 of the preferred embodiment has a small indentation 42 in its side wall which marks an initial or starting position for purposes of placing the disks 10 on a shaft 50. At this initial position, the tip 25 of the cutting edge 21 on the first tooth 20*a* is lined up with a "peak" 41*a* in the serrated lining of the aperture 40. On the other hand, the tip 25 of the cutting edge 21 on the teeth 20*b* and 20*d* adjacent the first tooth are lined up with "valleys" 41*b* in the serrated lining. The tip 25 of the cutting edge 21 on the tooth 20*c* opposite the first tooth 20*a* is lined up with a peak 41*a*. This alternating pattern is critical to achieving a ten degree offset between individual disks 10 on a shaft 50. To explain further, the first disk 10 is placed on the shaft 50. If the disks 10 are to be individually offset with respect to each other, the shaft 50 is rotated one hundred degrees before the next disk 10 is placed on the shaft 50. If the shaft 50 were only rotated ten degrees, the serrated lining 41 of the aperture 40 would not be flush with the shaft 50 and a twenty degree offset would result. If the disks 10 are not individually offset, but rather are offset in groups of two or more, the shaft 50 is rotated, as just described, between groupings.

Figure 5:
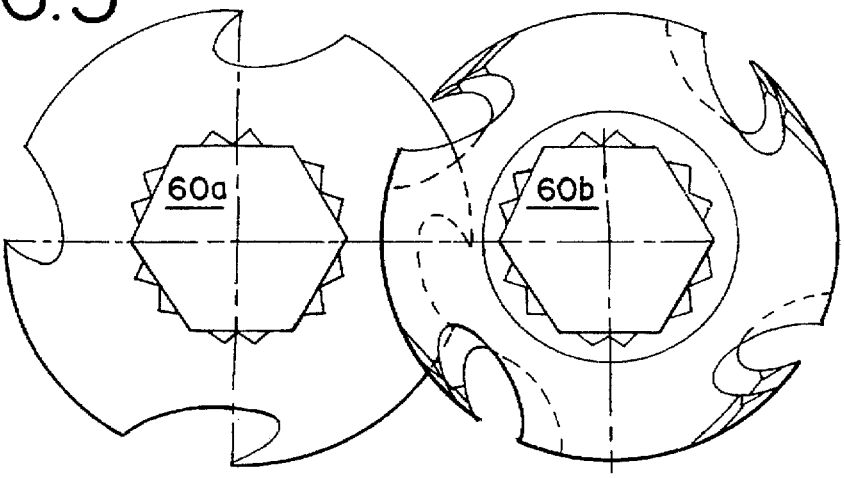
FIG. 5 is a perspective view of a portion of a dual cylinder arrangement containing the cutting disks of FIG. 1.

The meshing relationship between the cutting disks 10 on opposite cutting cylinders 60 can best be seen in FIG. 5. As shown in FIG. 5, the teeth 20 of a disk 10 on the first cutting cylinder 60*a* will overlap with the cutting surface 24 on a disk 10 of the second cutting cylinder 60*b*. In this way, the teeth 20 on the first cutting cylinder 60*a* will alternately engage in the paper with the teeth 20 on the second cutting cylinder 60*b*. Furthermore, as evident in FIG. 5, once the cutting edge 21 of a disk 10 on one cylinder 60*a* contacts the paper, it remains sandwiched between the adjacent disks 10 on the other cutting cylinder 60*b* and thus is unexposed until it completes the cutting cycle. This meshing arrangement is important to obtain the cross-cutting action which produces the confetti or small chips instead of kinked strips which can be produced when the proper meshing arrangement is not maintained.

It should be understood that the cutting disk 10 described above can be changed in many ways yet still remain within the scope of the invention. For example, the number or shape of teeth 20 could vary. Another variation may alter the number of serrations 41 lining the aperture 40, thereby changing the manner of indexing the disk 10 on the shaft 50.

The present invention also includes the method of making the cutting disk 10. The cutting disk 10 is produced by a two part process which involves molding and sintering. Firstly, metal powder is molded into the desired shape. Any hard metal powder is suitable. The industry designation for one such powder is FL4607. The metal powder is then placed in a press that has the desired shape. The press holds the metal powder together under high pressure. Thus, the desired shape is produced. Next, the molded metal is sintered. During sintering, the molded metal is heated at a high temperature thereby melding the metal particles together. Sintering produces a very hard, porous cutting disk.

The cutting disk 10 of the present invention provides many advantages. The cutting disk 10 enables small paper chips to be produced by a machine that is less noisy than many prior art paper shredders. In addition, the cutting disks 10 provide for a more energy efficient shredder because they require less power to accomplish the desired results.

Another advantage lies in the fact that the disks 10 are produced by sintering. Sintering enables disks of the requisite shape and hardness to be manufactured economically.

Of course, it should be understood that a wide range of changes and modifications can be made to the preferred embodiment described above. It is therefore intended that the foregoing description illustrates rather than limits this invention, and that it is the following claims, including all equivalents, which define this invention.

What is claimed:

1. A cutting disk comprising a plurality of circumferentially spaced teeth that do not protrude past the perimeter of the disk, each tooth having a tapered perimeter and an angled cutting edge, the perimeter and cutting edge of each tooth being tapered and angled, respectively, in the same direction as the perimeters and cutting edges of the other teeth.

2. The cutting disk recited in claim 1 wherein there are four teeth.

3. The cutting disk recited in claim 1 further comprising a central aperture lined with a plurality of serrations.

4. The cutting disk recited in claim 3 wherein there are eighteen serrations.

5. The cutting disk recited in claim 1 wherein the perimeter of each tooth is tapered to an angle in the range of 20 to 45 degrees.

6. The cutting disk recited in claim 1 wherein the cutting edge of each tooth is angled in the range of 20 to 90 degrees.

7. The cutting disk recited in claim 1 further comprising a spacer located on one side of the disk, the spacer having a smooth outer surface and an inner lining that is coextensive with the lining of the central aperture.

8. The cutting disk of claim 7 wherein the inner lining has eighteen serrations.

9. The cutting disk recited in claim 1 wherein the cutting disk is made out of sintered metal.

10. A cutting disk for use in a shredder comprising:

a) four circumferentially spaced teeth that do not protrude past the perimeter of the disk, each tooth having a tapered perimeter and an angled cutting edge, the perimeter and cutting edge of each tooth being tapered and angled, respectively, in the same direction as the perimeters and cutting edges of the other teeth;

b) a central aperture lined with eighteen serrations; and c) a spacer located on one side of the disk, the spacer having a smooth outer surface and a serrated inner lining that is coextensive with the lining of the central aperture.

11. The cutting disk recited in claim 10 wherein the perimeter of each tooth is tapered to an angle in the range of 20 to 45 degrees.

12. The cutting disk recited in claim 10 wherein the cutting edge of each tooth is angled in the range of 20 to 90 degrees.

13. The cutting disk recited in claim 10 wherein the cutting disk is made out of sintered metal.

14. A cutting cylinder for a shredder comprising:

a) a hexagonal shaft; and b) a plurality of cutting disks mounted on the shaft, each cutting disk comprising:

i) a plurality of circumferentially spaced teeth that do not protrude past the perimeter of the disk, each tooth having a tapered perimeter and an angled cutting edge, the perimeter and cutting edge of each tooth being tapered and angled, respectively, in the same direction as the perimeters and cutting edges of the other teeth; and ii) a central aperture for placing the disk on the shaft.

15. The cutting cylinder recited in claim 14 wherein the perimeter of each tooth is tapered to an angle in the range of 20 to 45 degrees.

16. The cutting cylinder recited in claim 14 wherein the cutting edge of each tooth is angled in the range of 20 to 90 degrees.

17. The cutting cylinder recited in claim 14 wherein the central aperture is lined with a plurality of serrations.

18. The cutting cylinder recited in claim 17 wherein the lining has eighteen serrations.

19. The cutting cylinder recited in claim 14 further comprising a spacer located on one side of the disk, the spacer having a smooth outer surface and an inner lining that is coextensive with the lining of the central aperture.

20. The cutting cylinder recited in claim 19 wherein the inner lining has eighteen serrations.

21. The cutting cylinder recited in claim 14 wherein the disks are individually offset with respect to each other.

22. The cutting cylinder recited in claim 14 wherein the disks are offset in ten degree increments.

23. The cutting cylinder recited in claim 14 wherein the disks are offset in groups of two or more.

24. The cutting cylinder recited in claim 23 wherein the disks are offset in ten degree increments.

25. A shredder comprising two parallel cutting cylinders, each cylinder having a hexagonal shaft and a plurality of spaced apart cutting disks with the cutting disks of the first cutting cylinder interleaved with the cutting disks of the second cutting cylinder, each cutting disk comprising:

a) four circumferentially spaced teeth that do not protrude past the perimeter of the disk, each tooth having a tapered perimeter and an angled cutting edge, the perimeter and cutting edge of each tooth being tapered and angled, respectively, in the same direction as the perimeters and cutting edges of the other teeth; and b) a central aperture for placing the disk on the shaft.

* * * * *